United States Patent [19]

Mauge et al.

[11] Patent Number: 4,907,159

[45] Date of Patent: Mar. 6, 1990

[54] DEVICE FOR RECEIVING AND PROCESSING ROAD INFORMATION

[75] Inventors: Jacques F. Mauge; Serge Verron, both of Eindhoven, Netherlands

[73] Assignee: U.S. Philips Corporation, New York, N.Y.

[21] Appl. No.: 190,542

[22] Filed: May 5, 1988

[30] Foreign Application Priority Data

May 9, 1987 [EP] European Pat. Off. ..... 87200845.3

[51] Int. Cl.[4] ..... G08G 1/09

[52] U.S. Cl. ..... 364/436; 340/993; 364/424.01

[58] Field of Search ..... 364/436, 424.02, 424.01, 364/424.05; 340/989, 990, 992, 993, 905

[56] References Cited

U.S. PATENT DOCUMENTS

| | | | |
|---|---|---|---|
| 3,845,289 | 10/1974 | French | 364/436 |
| 4,092,718 | 5/1978 | Wendt | 364/436 |
| 4,220,946 | 9/1980 | Henriot | 364/436 |
| 4,301,506 | 11/1981 | Turco | 364/436 |
| 4,350,970 | 9/1982 | von Tomkewitsch | 364/436 X |
| 4,713,661 | 12/1987 | Boone et al. | 340/994 |
| 4,799,162 | 1/1989 | Shinkawa et al. | 364/436 |

FOREIGN PATENT DOCUMENTS

| | | |
|---|---|---|
| 2462834 | 2/1981 | France . |
| 2050767 | 1/1981 | United Kingdom . |

OTHER PUBLICATIONS

S.R. Ely and D. Kopitz, "Design Principles for VHF/FM Radio Receivers Using the EBU Radio-Data System RDS", EBI Review -Technical, No. 20, Apr. 1984, pp. 50-58.

*Primary Examiner*—Parshotam S. Lall
*Assistant Examiner*—Thomas G. Black
*Attorney, Agent, or Firm*—Thomas A. Briody; Jack E. Haken; Anne E. Barschall

[57] ABSTRACT

Device for receiving and processing road information messages transmitted in digital form, each message including at least a first section for indicating the zone of the road network to which the message refers, which device includes for the control of the data processing a data processing unit which is connected to a bus for the transfer of data, to which bus are also connected a reception memory for temporarily storing the received messages, a selection unit enabling the selection from among the stored messages of those concerning a zone to be designated and a presentation unit for presenting the selected messages. The device also includes a message analysis unit which includes a zones table memory, which analysis unit is provided for recognizing the zone in question each time a message is received on the basis of the said first section of the received message and for storing in the zones table, by means of at least one indicator for each message, the received messages according to the zone to which they belong, which selection unit is provided for accessing the zones table and for carrying out the said selection by fetching messages for the designated zone in the zones table.

24 Claims, 10 Drawing Sheets

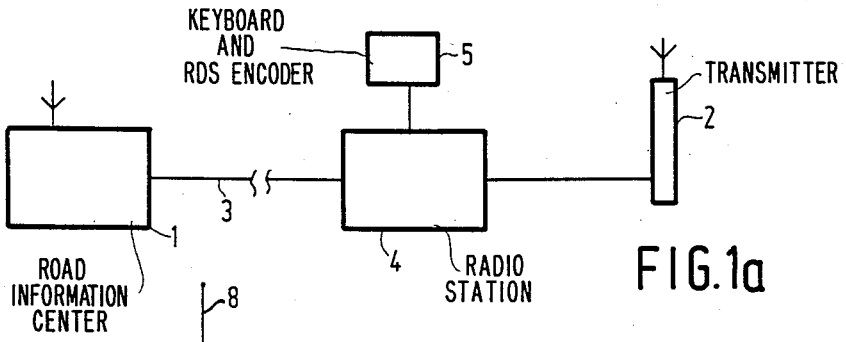
FIG.1a
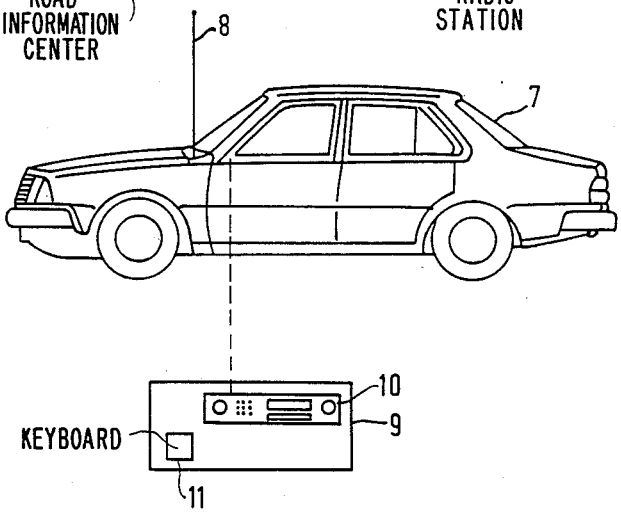
FIG.1b
| BL1 | | BL2 | | | | | | BL3 | | BL4 | |
|---|---|---|---|---|---|---|---|---|---|---|---|
| PI | A | TG | TP | PTY | EB | BB | SYNC SI | B | SMR 1 | C | SMR 2 | D |
FIG.2
| | TG | B0 | EB | BB | SI | SMR1 | C | SMR2 |
|---|---|---|---|---|---|---|---|---|
| MA | 1 0 0 0 | 0 | 0 | 1 | 0 0 0 | X X | C | X' X' |
| MB(1) | 1 0 0 0 | 1 | 0 | 0 | 0 0 1 | Y Y | C' | Y' Y' |
| MB(2) | 1 0 0 0 | 0 | 0 | 0 | 0 0 0 | Z Z | C | Z' Z' |
FIG.6

| REG | ADD-MES | | | | | | | | | | CS/R | DEB-REG |
|---|---|---|---|---|---|---|---|---|---|---|---|---|
| B2 | 12 | 21 | 34 | 38 | | | | | | | 4 | 10 |
| B5 | 50 | | | | | | | | | | 1 | 8 |

FIG. 7a

| CL R RNN | ADD-MES | | | | | | | | | | CS/RNN | DEB-RNN |
|---|---|---|---|---|---|---|---|---|---|---|---|---|
| A8 | 12 | 13 | 28 | 34 | 38 | 52 | 71 | | | | 7 | 15 |
| RN 64 | 50 | | | | | | | | | | 1 | 5 |

FIG. 7b

| CLR RNN | REG-ALL | DEB |
|---|---|---|
| A1 | B8, B9 | 8 |
| A2 | B3, B4, | 12 |
| ⋮ | | |
| RN1 | B1, | 7 |
| RN2 | B3, B5 | 5 |
| ⋮ | | |

FIG.8a

| REG | RNN-ALL | DEB |
|---|---|---|
| B1 | A5, RN1 | 15 |
| B2 | D64, RN15 | 10 |
| B3 | A2, RN2 | 9 |
| B4 | A2, RN27 | 9 |

FIG.8b

| CLR RNN | ORD | ADR |
|---|---|---|
| A7 | 2 | 1024 |
| | 12 | 1247 |
| | 256 | 15000 |
| A8 | 2 | 3589 |
| | 4 | 678 |
| | 6 | 2376 |
| | 28 | 7812 |
| NZ34 | 2 | 2673 |

FIG.12a

| ADR | TXT APP | PAR | RES |
|---|---|---|---|
| 0000 | AACHEN | 04 3B | B2 |
| 1024 | HAMBURG | 02 2C | B12 |
| 1025 | HAMBURG-SUD | 02 2D | D25 |
| 1247 | KIEL | 02 1Q | B13 |
| 2376 | RHUEDEN | 08 BF | B75 |
| 3589 | SEESEN | 08 DE | D75 |
| 65535 | SOUTH | 0F F6 | D34 |

FIG.12b

DEVICE FOR RECEIVING AND PROCESSING ROAD INFORMATION

BACKGROUND OF THE INVENTION

The present invention relates to a device for receiving and processing road information messages transmitted in digital form, each message including at least a first section for indicating the zone of the road network to which the message refers, which device includes for the control of the data processing a data processing unit which is connected to a bus for the transfer of data, to which bus are also connected a reception memory for storing the received messages, a selection unit enabling the selection from among the stored messages of those concerning a zone to be designated and a presentation unit for presenting the selected messages.

Such a device is known from the article entitled "Design Principles for VHF/FM radio receivers using the EBU radio-data system RDS" by S. R. Ely and D. Kopitz which appeared in the Review of the UER-Technique No. 204, April 1984, pages 50–58. In the system described the road information messages are coded according to the specifications of the data radio broadcast system RDS (Radio Data System) and transmitted from a radio station. A first section of each transmitted message indicates the zone of the road network to which the message refers. This zone can be formed by a road or by a region of a country. When the device receives a road information message it will, under the control of the data processing unit, temporarily store the message in the reception memory. The user who desires the road information messages for a zone according to this choice will use the selection unit in order to indicate the chosen zone to the central processing unit. Under the control of this data processing unit, the content of the reception memory will be completely scanned for messages concerning the designated zone. Each message thus referenced will be transmitted to the message presentation unit which presents them to the user. Thus the user is able to receive only the road information messages which relate to the zone of his choice.

A disadvantage of the known system is that for each request formulated by the user, the reception memory is completely scanned. At each request this imposes a heavy load on the data processing unit and can, when there is a large quantity of messages stored in the reception memory, impose a relatively long scan time.

SUMMARY OF THE INVENTION

The object of the invention is to produce a device for receiving and processing road information messages wherein it is not necessary, at each request, to scan the entire content of the reception memory and wherein the scan time is substantially reduced.

A device for receiving and processing road information messages according to the invention is characterized in that the device includes a message analysis unit which includes a zone table memory, which analysis unit has means for recognizing the zone in question each time a message is received on the basis of the said first section of the received message and for storing in the zones table, by means of at least one indicator for each message, the received messages according to the zones to which they belong, which selection unit is provided for accessing the zones table and for carrying out said selection by fetching messages for the designated zone in the zones table.

The message analysis unit will, after each reception of a message, analyse the first section of the message in order to recognize the zone to which it refers. When the analysis unit has recognized the zone to which the received message refers it will place at least one indicator for this message in the zones table at a location designated for this zone. This indicator is for example formed by the address at which the message in question is stored in the reception memory. When the user has indicated the zone of his choice, the selection unit will select in the zones table only the location designated for the requested zone. Thus the selection is carried out more quickly since it is no longer necessary to scan the entire content of the reception memory at each request but only to fetch the indicators stored at the location designated for the requested zone.

A first preferred embodiment of a device according to the invention is characterized in that the zones table memory includes a table of roads where the messages are placed according to the roads to which they refer and in that the indicators are constituted by the addresses at which the messages in question are stored in the reception memory. Thus the selection and the placing in the table of roads can be carried out on the basis of the category and the number of roads.

A second preferred embodiment of a device according to the invention is characterized in that the device is fitted with a detecting unit in order to detect in a received message the region to which it refers, which message analysis unit is connected to the detecting unit and in that the zones table in the memory includes a regions table where the messages are placed according to the regions to which they refer and in that the indicators are constituted by the addresses at which the messages in question are stored in the reception memory.

The detecting unit enables the detecting in a received message of the region to which it referes and thus offers the possibility of carrying out a selection and a storage on the basis of the regions.

Preferably the device includes a roads-region correspondence table for storing, for a predetermined number of roads of the road system to which the roads-regions correspondence table refers, an overflow index indicating the maximum number of road messages for each of the roads of the said predetermined number, said device being fitted with a verification unit connected to the roads-regions correspondence table and to the roads table in order to verify if the number of messages stored for each road has not reached the number indicated by the overflow index for the road in question, and in order to eliminate the presence of a messages for a road for which the number of messages stored in the roads table has reached the number indicated by the overflow index. The use of an overflow index and the verification unit enables the number of messages to be stored to be limited and a better sharing of the content of the reception memory between the different zones.

Preferably the verification unit has provision for carrying out the said elimination of the presence of the oldest message from among the said number of messages. The oldes messages are thus regularly eliminated thus enabling the reception memory not to be obstructed for the reception of new messages.

Preferably the detecting unit includes a roads-regions correspondence table wherein are stored for each of the roads of a predetermined number of roads of a road network at least one index indicating at least one region traversed by the road in question.

The use of a roads-regions correspondence table allows a certain freedom in the choice of the division of one or more countries into a number or regions. It is thus possible either to divide a country according to the existing provinces or departments, or to take a predetermine area for each region.

A third preferred embodiment of a device according to the invention is characterized in that the verification unit also has provision for detecting with the help of the roads-regions correspondence table and of the regions-roads correspondence table respectively to which region and to which road respectively the message whose presence has been eliminated relates to and also for eliminating from the regions table and from the roads table respectively the messages whose presence in the roads table and the regions table respectively has been eliminated.

When the device is provided with a roads table and a regions table it is essential, when the presence of a message has been eliminated from one of the two tables, to also eliminate the presence of this message in the other table.

In a device wherein each message includes at least one sequence composed of two blocks, and wherein each block includes an information section and a control section, the control section also including a shift word for the synchronization of the block, and wherein for a predetermined block a first and a second shift word can be used, a preferred embodiment of this device is characterized in that, for the first sequence of a message, the first shift word is used and for the other sequences of this same message the second shift word is used, and in that the device is provided with a decoder for decoding the shift word of a received message and generating a setting signal when decoding a first shift word, which device includes a sequence counter connected to the decoder, said sequence counter being set up under the control of a setting up signal. Thus it is possible to distinguish in a received message if it is a first sequence of a new message or not. The sequence counter enables the verification of the correct order of reception of the sequences.

Preferably the selection unit is provided with means enabling the selection between an intersection and/or a union of at least two zones.

Thus it is possible to formulate a choice over one or more zones or over an intersection of two or more zones.

In the case in which the message includes several sections in which coded words are given each time representing various parts of the information of the message, it is advantageous that the device is provided with a conversion memory connected to the presentation unit and which is addressable by different coded words and where other coded words are stored for the presentation of the message.

Thus it is possible to use the same coded words in different countries and, by means of the other coded words, to carry out a conversion into the language of the user and to store in the conversion memory only the information necessary in order to cover the country or countries concerned.

Preferably each message includes a third section which gives a shift value enabling the indication of another location with respect to the location contained in the second section, and in that the device is provided with an address generator for forming an address for the conversion memory on the basis of the second and third sections of the message. Thus it is possible to designate two different locations in a same message while limiting the number of bits used in the message.

When the device according to the invention is connected to a road navigation system for vehicles, which navigation system is fitted with means of determining a route between a start point and a destination, it is advantageous that the navigation system is fitted with means of transmitting to the selection unit at least one zone traversed by the said route and of receiving the messages relating to the designated zone, the said means for determining a route having provision for analyzing the received message and for recognizing in the received message if, there is a traffic problem in the designated zone and determining in the case of a traffic problem a new route. When the road navigation system is connected to the device according to the invention it can itself select the messages for the zone or zones traversed by the route which it has just determined. When it appears that there is now a traffic problem on the initially determined route, the means of determining a route can then determine a new route in order to bypass the traffic problem. Thus the device according to the invention can contribute its share to the improvement of road safety.

DESCRIPTION OF THE DRAWINGS

The invention will now be described in greater detail with the help of the Figures in which:

FIGS. 1*a* and 1*b* illustrate the environment in which a device according to the invention is used;

FIG. 2 shows the various components of the group structure of the RDS system;

FIG. 6 shows an example of the content of part of two messages;

FIGS. 7*a* and 7*b* respectively show examples of the regions and roads tables respectively;

FIGS. 8*a* and 8*b* respectively show an example of the roads-regions correspondence table and of the regions-roads correspondence table respectively;

FIGS. 12*a* and 12*b* respectively, illustrate examples of the extension table and of the places table respectively;

DETAILED DESCRIPTION OF THE INVENTION

Figure 3:
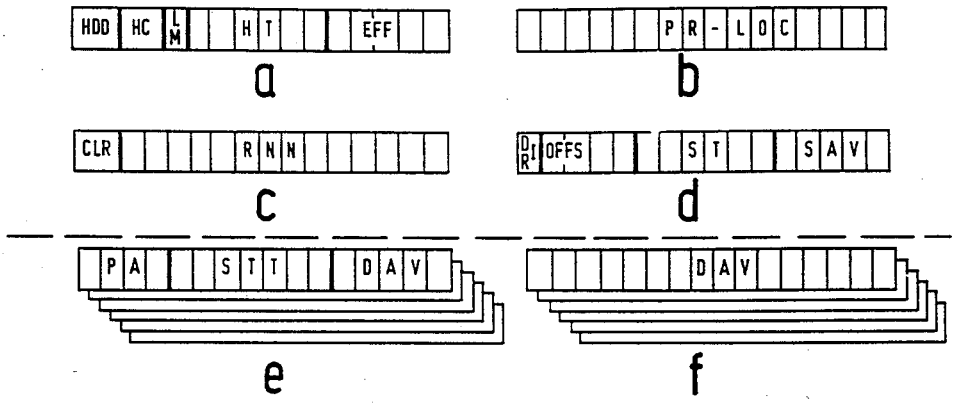
FIGS. 3(*a–f*) show an example of the sections SMR1 and SMR2 of a group in RDS format in greater detail.

FIG. 1 shows the environment in which a device according to the invention is used. A national (or regional) road information center (1) gathers all of the road information (accidents, works, traffic jams, ice, etcetera) which are transmitted to it. These items of road information are then selected and those which are of value for the correct flow of road traffic are transmitted by means of a link 3 to a radio station 4. The radio station is equipped for coding the message and transmitting them according to the RDS (Radio Data System) system.

The RDS format messages are then transmitted by use of radio waves emitted by the transmitter 2.

Such a RDS system is for example described in the article "Design Principles for VHF/FM radio receivers using the EBU radio-data system RDS" by S. R. Ely and D. Kopitz which is published in the Review of the UER-Technique No. 204, April 1984, pages 50–58. The radio stations can also add other messages to those which are supplied to it by the road information center, for example the presence of a radar control at a specified place. For this purpose the radio station is equipped with a unit 5 formed for example by a keyboard and an RDS encoder. In order to pick up RDS format messages, a vehicle 7 shown in FIG. 1*b* must be fitted with a receiving antenna 8 and a radio receiver 9 capable of receiving and decoding the messages transmitted in RDS format. The radio receiver 9 also includes a radio (−cassette player) 10 and a keyboard 11. Unlike the known road information broadcasting system where the driver is obliged to have his radio receiver tuned to a station transmitting, in the language of the country, road information on all of the national networks in series and at predetermined hours, the RDS system offers the user the possibility of having, at any time of the day, road information for one road or one region depending on his own choice and to hear this road information in his own language.

FIG. 2 shows the various components of the group structure of the RDS system. The group comprises 104 bits and is divided into four blocks. Each block is composed of an information section of 16 bits and a section (10 bits) for the protection of this information. The block BL1 comprises:

PI (16 bits) this is the identification of the program A and the 10 control bits which serve for the protection and identification of the block.

The sections B, C and D of the other blocks have the same function in their respective blocks as the section A has in block BL1. The block BL2 comprises:

TG there are 5 bits which identify the group, for example road information, information relating to the radio programs, etcetera;

The next bit TP informs whether the station gives road messages or not;

PTY comprises five bits which indicate the type of program, for example sport, classical music, etcetera SYNC this is a synchronization word used by the receiver for processing the message, which is divided up as follows:

EB this is an extension bit which, when set, for example to the value EB=1, indicates another application of the message from that initially provided, for example a radio text.

BB this is a bit which indicates a link between the successive messages in the sense that its value is changed each time that a new message having no relation with the previous message is transmitted. For example if the groups, of a message N have the bit BB=1, the groups of the messages N−1 and N+1 will have the bit BB=0.

SI these are three sequence identification bits which server to identify the order of the sequence in a message.

If for example a message includes three sequences, the first, second and third sequences respectively will have SI=010, SI=−11 and SI=000 respectively. In the example chosen a message will therefore include a maximum of eight sequences. The advantage of counting by decrementation is in the fact that the system can thus be currently aware of the number of sequences of a same message which will follow and can also detect if sequences are missing. The blocks BL3 and BL4 include SMR1, SMR2, which are two subsequences of 16 bits each including the road information itself and which together form a sequence identified by the bits SI.

The messages, in the case in which they remain current, are repeated and in the opposite case are updated approximately every five minutes. In this period of about five minutes, the transmitter can transmit 420 road information messages in RDS format using 25% of the total capacity of the RDS resource.

FIG. 3 shows in greater detail an example of sections SMR1 and SMR2 of a group in RDS format. In general a same message will be composed of two sequences distributed over two successive groups. FIGS. 3*a* and *c*, and FIGS. 3*b* and *d* respectively represent the subsequences SMR1 shown in FIG. 3*a* includes the bits HDD which are two bits representing the destination of the message in the device, for example.

HDD=00 signifies that the message is only intended to be presented to the driver by audio means (speech synthesis).

HDD=01 signifies that the message can be presented to the driver by audio means and/or display on a screen.

HDD=10 signifies that the message is intended to update a memory containing geographic data and which is for example part of a navigation system with which the vehicle could be fitted. Such a message for example indicates that a road is removed or added to the network.

HDD=11 signifies that the message is intended for a data processing unit, for example a microprocessor with which the device is fitted. Such a message indicates for example that the previous message was false or that it is necessary to cancel messages. The codes HDD=00 and HDD=01 indicate the intention of the sender of the message. It is obvious that the receiver can be designed according to safety standards in order to react to a message coded in HDD = 01 by presenting this message only by audio means if the vehicle is for example running.

The subsequence SMR1, illustrated in FIG. 3*a*, also includes the bits:

HC which are two bits indicating four different categories of information, for example:

HC=00: road traffic information

HC=01: meteorological information

HC=10: alarm information

HC=11: announcements.

LM which is one bit, which when it is set, for example to the value 1, indicates that the message includes more than two sequences. When the receiver receives a frame having LM=1, it is informed that the message will include more than two sequences and that it is therefore a "long" message. Such long messages can for example be used for road information relating to other countries than that in which the transmitter is located, or for information relating to vehicle categories (for example heavy goods vehicles).

HT which are six bits which indicate the cause which is at the origin of the transmission of the message in question. This cause is naturally in direct relation with the category HC. These six bits offer the possibility of forming 64 different causes per category of information, and since there are four information categories, a total of $4\times64=256$ different informations can thus be formed.

EFF which are five bits indicating the consequence of the cause HT. These five bits offer the possibility of forming 32 different consequences and in combination with HT and HC $4\times64\times32=8192$ different information can thus be formed.

Consider for example the message having a section SMR1 equal to 00010 000001 00101. The different sections of this message therefore indicate for example HD=00=audio information only
HC=01=meteorological information
LM=0=short message (2 sequencex)
HT=000001: snowfall
EFF=00101: "road blocked".

This message thus informs the driver by audio means only that the road is blocked because of snowfall. The decoding and the presentation of this message is carried out by means of the device which will be described in greater detail below.

The subsequences SMR2 shown in FIG. 3*b* is composed by the information PR-LOC alone. This information PR-LOC is composed of 16 bits and indicates the place or the area to which the message referes (for example a tunnel, a motorway exit or the name of a town).

The subsequences SMR1 of the second sequence of the message and shown in FIG. 3*c* includes the section CLR, RNN. The section CLR includes two bits which indicate the class to which the road belongs, for example

| | |
|---|---|
| 01: | first class road |
| 10: | second class road |
| 11: | other roads. |

The section RNN is composed of 14 bits and indicates the number of the road to which the message relates. In combination with CLR a total of $4\times16384=65536$ different roads can thus be indicated. This enormous capacity thus enables the coding of all the roads of a same country without having recourse to conversion tables from one country to another.

The subsequence SMR2 of the second sequence of the message and shown in FIG. 3*d* includes the sections DIR, OFFS, ST and SAV.

The section DIR comprises one bit which indicates the direction.

The section OFFS includes four bits and servers to provide a more detailed specification with respect to the place (PR-LOC) to which the message refers. The section OFFS therefore indicates a second place with respect to the place quoted in the PR-LOC. The section DIR and the section OFFS can for example indicate:

| | |
|---|---|
| 0 0000 | no second place in the same direction |
| 1 0000 | no second place in the opposite direction |
| 0 0001 to 1111 | a positive shift between 1 and 15 to be added to PR-LOC |
| 1 0001 to 1111 | a negative shift between 1 and 15 to be added to PR-LOC |

The section ST comprises 6 bits and indicates an estimate of the duration of the problem to which the message referes, for example in the case in which the message indicates a blocked road, the section ST indicates for example a time at which the road will probably again be open to traffic. The $64=2^6$ possibilities offered by the 6 bits can for example be divided into 6 bits can for example be divided into 48 (half-hours per day)+7 (days per week)+4 (week per month)+5 (months).

The section SAV comprises 5 bits which indicate static road advice, for example such as "winter equipment necessary" or "slow down". In the case in which the 5 bits of the section SAV (FIG. 3*d*) are not sufficient, the warning can be complemented by means of long messages (section DAV of FIGS. 3*e* and *f*), in these DAV sections there can then be given dynamic advice, which can complete the static advice if necessary. For example in the case of an SAV "slow down", the DAV section can indicate "to 70 km/h".

The subsequences SMR1 shown in FIG. 3*e* comprises the sections PA, STT and DAV. The section STT (6 bits) indicates a start time (for example starting from "22.00 hours"). The section PA comprises 4 bits and serves to indicate another country than that covered by the transmitting station.

Figure 4:
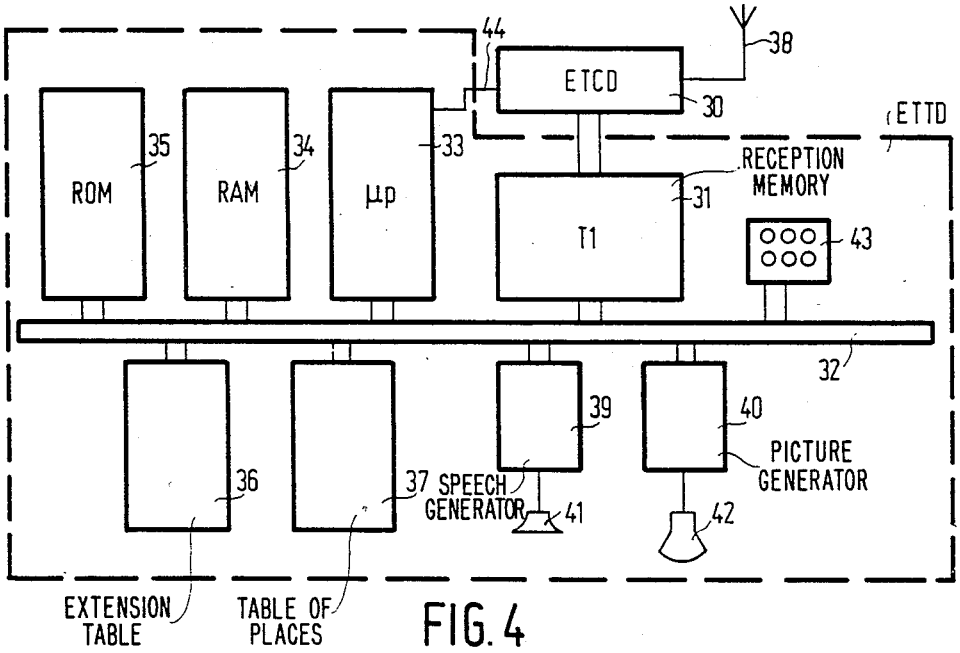
FIG. 4 is a block diagram of an example of a device according to the invention.

FIG. 4 is a block diagram of an embodiment of a device according to the invention. The device includes a data collection equipment (ETCD) which itself comprises a radio receiver 30 connected to an antenna 38 and has provision for receiving messages coded in an RDS format. The ETCD is connected to a data processing terminal equipment (ETTD) which itself comprises a reception memory 31 for storing the messages received by the ETCD, which memory is in its turn connected to a bus 32 for the carrying of data (addresses+-data). To the bus 32 are also connected a data processing unit 33, for example a microprocessor, a read only memory 35, a random access memory 34, an extension table 36 and a table of places 37, a presentation unit formed by a speech generator 39, and a picture generator 40 and a selection unit also including a keyboad 43, all of these components forming part of the data terminal equipment. An output of the speech generator 39 and of the picture generator 40 respectively is connected to the loudspeaker 41, which can be the same as that used by the radio, and to a display unit 42 respectively. The picture generator 40 and its display unit 42 are optional.

Figure 5:
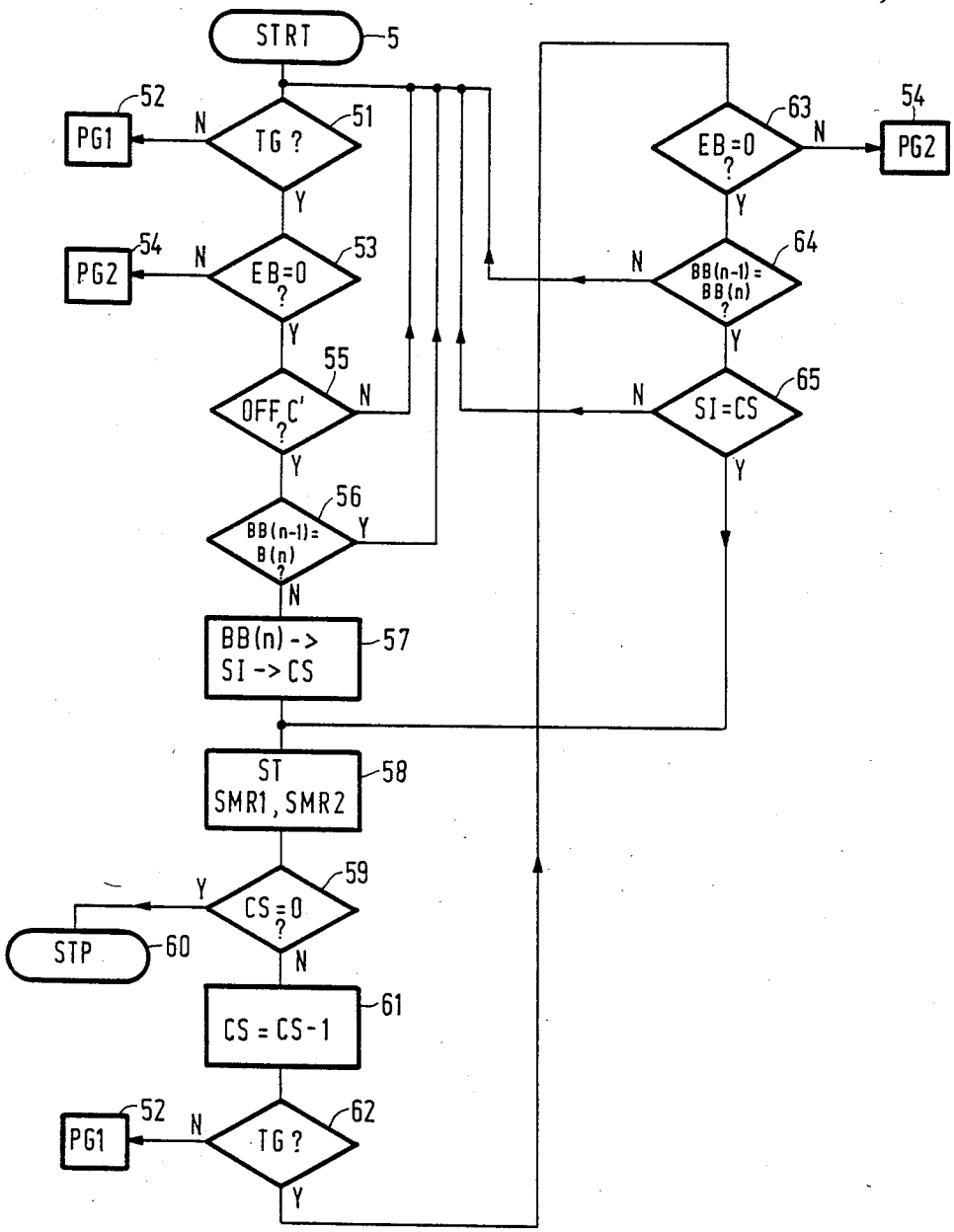
FIG. 5 illustrates an example of a message analysis processor by means of a flowchart.

Each message in RDS format received by the radio receiver is immediately stored in the reception memory 31 under the control of the data processing unit 33. The data processing unit 33 is informed, by means of a signal transmitted on the line 44, each time a new message is received. The data processing unit 33 then starts a message analysis process of which an example will be described by means of the flowchart shown in FIG. 5. The various steps of the analysis process will now be described below.

50 STRT: start of the analysis process.

51 TG?: the bits TG which identify the group are analyzed in order to verify if it is a message containing road information.

52 PG1: in the case in which the TG bits indicate that the message does not comprise road information, the data process unit (33) jumps to another program PG1 which will then process the message in question.

53 EB=0?: the extension bit is checked in order to detect if it carries the value EB=0, indicating that the message is not used for applications other than road information.

54 PG2: In the case in which the extension bit has a value EB=1, the data processing unit 33 jumps to another program PG2 which will then process the message in question.

The program PG1 and PG2 will not be described in detail since the device according to the invention more particularly processes messages containing road information.

55 OFF-C'?: This is a test which servers to check if the received sequence is the first one of a new message. In a preferred form of the device according to the invention this check is carried out using the shift word included in the block BL3 of the group. In order to indicate that it is a first sequence of a new message, a first shift word (C') is used instead of a second shift word (C) which is used to indicate the other sequence of the message (on this subject see appendix 1 (page 33, March 1984 issue) of the specifications of the RDS system for the broadcasting of data by frequency modulated radio published by the Union Européenne de Radiodiffusion). The data processing unit then carries out a shift operation on the block BL3 in order to note if the first shift word C' has been used. The shifting of the first shift word will generate a selling signal which will then indicate to the data processing unit that it is the first sequence of the message. In the case in which the first shift word is not detected, either due to an error in the block BL3, or due to a value which is different from the first shift word, the data processing unit 33 will abandon the message and will wait for the arrival of another group.

56 BB(n−1)=BB(n)?: This is a test which serves to establish if the linking bit BB of the received group (group n) is equal to the linking bit of the preceding group (group n−1). A negative result of this operation indicates that it is a new message. In order to carry out this operation, the bit BB(n−1) is for example stored in a buffer register in the data processing unit.

57 BB(n)→; SI→CS: The data processing unit 33 loads the value BB(n) into the buffer register and sets, under the control of the setting signal, a sequence counter CS to the value SI. The value SI is the value indicated by the sequence identification bits of the received group. The counter CS is used on the one hand for indicating the number of addresses to be reserved in the reception memory, and on the other hand in order to form the addresses in the reception memory at which the sequences must be stored.

58 St SMR1, SMR2: The data processing unit forms, with the help of the counter CS, the addresses at which the subsequences SMR1 and SMR2 of a received sequence must be stored in the reception memory 31, and then stores the subsequences SMR1 and SMR2 at the indicated addresses.

59 CS=0?: This is a test which serves to check if the counter CS is indicating the value "0" which indicates that all of the sequences of a same message have been stored.

60 STP: This indicates the end of the process, which is achieved when all of the sequences of a same message have been stored (CS=0).

61 CS=CS−1: Decrementation of the value indicated by the counter CS by one unit.

62 TG?: The bits which identify the group are analyzed in order to verify if it is a message containing road information.

63 EB=0: this step is identical to step 53

64 BB(n−1)=BB(n): this step is identical to step 56.

65 SI=CS: This is a test which serves to check if the value indicated by the sequence identification bits of a new received group corresponds to the value indicated by the counter CS. Thus the data processing unit 31 can check if the new received group includes the correct sequence number. If this is not the case, the processing of the message is interrupted.

The different steps in the analysis process will now be illustrated with the help of an example given in FIG. 6, where these sections of the group which have a function in the analysis process are collected. In this FIG. 6, the message MB comprises two sequences and only the last sequence of the message MA is shown in order to illustrate the changing of the linking bit BB. The value TG=1000 indicates that it is a message including road information. Let it be assumed that the last part of message MA has been processed and that the value BB=1 is therefore stored in the buffer register. When the radio receiver ETCD has received the first group of the message MB, it informs the data processing unit 33 which starts (50) the analysis process. Since it is a matter of road information (TG=1000) and the extension bit EB=0, the tests at steps 51(TG?) and 53(EB=0?) are positive and the process passes to step 55 (OFF-C'?). During this step the data processing unit 33 establishes that the shift word of the block BL3 is a first shift word (type C'). It is therefore a first sequence of the message and the process passes to the next stage 56 (BB(n−1)=BB(n)?) where it is established that BB(n−1)=1 and BB(n)=0 and that therefore BB(n−1)≠BB(n). This negative result causes the data processing unit 33 to pass to step 57 where the value BB(n)=0 is stored in the buffer register and where the counter CS is set to the value CS=SI=001. The data processing unit 33 then passes to step 58 where the address ADD1 is formed and where the sections SMR1 (YY) and SMR2(Y'Y') are stored at the address ADD1. The address ADD1 is for example formed in the following way ADD1=FF+CS.

The value FF being the address of the first free location in the reception memory 31, this value is for example stored in a second buffer register of the data processing unit 33. (The values YY and Y'Y' represent the content of the section SMR1 and SMR2.) The data processing unit then passes to step 59 (CS=0?) and establishes that since CS=001 it can therefore pass to step 61 in order to form CS=001−001=000. The data processing unit 33 then awaits the reception of a new group, for example unit then awaits the reception of a new group, for example the group MB(2) and when this new group is received the steps 62(TG=11) 63(EB=0) and 64(BB(n−1)=0=BB(n)) are executed. In step 65 the data processing unit establishes that SI=CS, and passes to step 58 where the addresses ADD2=FF+001 are formed and where the values ZZ and Z'Z' are stored at the address ADD2. In step 59 it is established that CS=0 and the sequence passes to 60 in order to complete the process.

The case where SI=010 in the group MB(2) (FIG. 6) will now be considered. In this case the data processing unit 33 establishes during step 65 that SI=010 and CS=000. SI is therefore different from CS and the data processing unit will pass to step 51. It can thus be seen that a group which does not have the correct sequence number is not taken into consideration. The same thing would be valid if the group MB(2) would have BB=1 (a negative result to the test in step 64).

After having stored a received message in the reception memory 31, the data processing unit 33 will analyze the content of the message in order to detect the zone (road, region) to which the message refers. For this purpose the data processing unit 33 uses a zones table memory formed from two tables which are shown in FIGS. 7*a* and 7*b*. These tables are, in a preferred form of the devices according to the invention, part of the random access memory (34, FIG. 4) of the device. It will be clear that these tables can also be formed by two individual memories (RAM type) connected to the bus 32. FIG. 7*a* shows the table of regions which is used in order to classify the messages according to the geographic regions to which they refer. These regions can correspond to the geographic division of the country (province, department) or can be formed by an arbitrary division of the country. The table is in matrix form and is addressable by row and by column. In the first column the indexes indicating the various regions are stored (for example regions B2 and B5). The columns entitled ADD-MES serve for storing the indicators, for example the addresses (ADD) at which the messages belonging to the region of their respective row are stored in the reception memory 31. In the example of FIG. 7*a*, there are, at addresses 12, 21, 34 and 38, messages for the region B2 and for the region B5 there is one message at address 50. The column CS/R indicates the number of messages for the region in question (four for B2, one for B5) and the column DEB indicates the overflow index for the region in question.

The overflow index for the region is a number allocated to this region which indicates the maximum number of messages allocated for the region in question. In an elementary form of the device according to the invention this overflow index is the same for each region and the column DEG-REG is not included in the regions table. However in a preferred form of the device according to the invention a dedicated overflow index is allocated to each region. The advantage of this preferred form resides in the fact that the road traffic density rate varies from region to region and from road to road. In France for example the Paris region, having a high traffic density, will have an overflow index greater than that of Auvergne. It is obvious that the larger the traffic density becomes, the larger will be the probability that there will be one or more road messages. The overflow index thus enables the capacity present in the tables and in the reception memory to be suitably shared. The various overflow indexes are for example stored in a table as described below.

FIG. 7*b* shows the roads table which is used for classifying the messages according to the numbering of the roads (class+number, CLR, RNN) to which they refer. The roads table is organized in the same way as that of the regions. The column CS/RNN indicates the number of messages for the road in question and the column DEB-RN indicates the overflow index for the road in question.

Before explaining how the roads table and the regions table are loaded it is necessary to describe how the region to which a received message refers is obtained from that message. As explained with the help of FIG. 3, the message does not include any section in which the region in question is given. However an indicator could be given in the section PR-LOC indicating the region and the analysis can then be carried out on the basis of the region using the section PR-LOC.

The device according to the invention uses, in order to recognize which region a received message refers to, a roads-regions correspondence table which is shown in FIG. 8*a*. This roads-regions correspondence table can be contained in de ETTD read only memory 35 or can be formed in an independent memory connected to the bus, which could, if necessary, even be in the form of a cassette or a memory board, thus enabling the regular updating of the roads-regions correspondence table.

The roads-regions correspondence table is addressable by means of the CLR-RNN section of the message. The roads-regions correspondence table includes a column REG-ALL where the regions traversed by the road in question are mentioned, and a column DEB where the overflow index of the road in question is mentioned. Thus for example the motorway A1 traverses the regions B8 and B9 and has an overflow index equal to 8.

The device according to the invention also includes a regions-roads correspondence table which is shown in FIG. 8*b* and which, like the roads-regions correspondence table, can be formed by an independent memory connected to the bus. The regions-roads correspondence table is addressable by means of the region code (REG) and includes a column RNN-ALL where the roads which traverse the region in question are mentioned, and a column DEB where the roads which traverse the region in question are mentioned, and a column DEB where the overflow index of the region in question is mentioned.

In order to mark the region to which a received message refers, the data processing unit will, in its detecting unit function, now proceed in the way described below. Let is be assumed that the message is a message for the motorway A2 (CLR=A, RNN=2). The data processing unit will therefore address the row A2 in the roads-regions correspondence table and will there read the references to the regions B3 and B4, as well as an overflow index of value 12. The data processing unit is thus informed that the message referring to the motorway A2 also refers to the regions B3 and B4. In order to find the overflow index of the regions B3 and B4, the data processing unit will read these data in rows B3 and B4 of the regions correspondence table.

Figure 9:
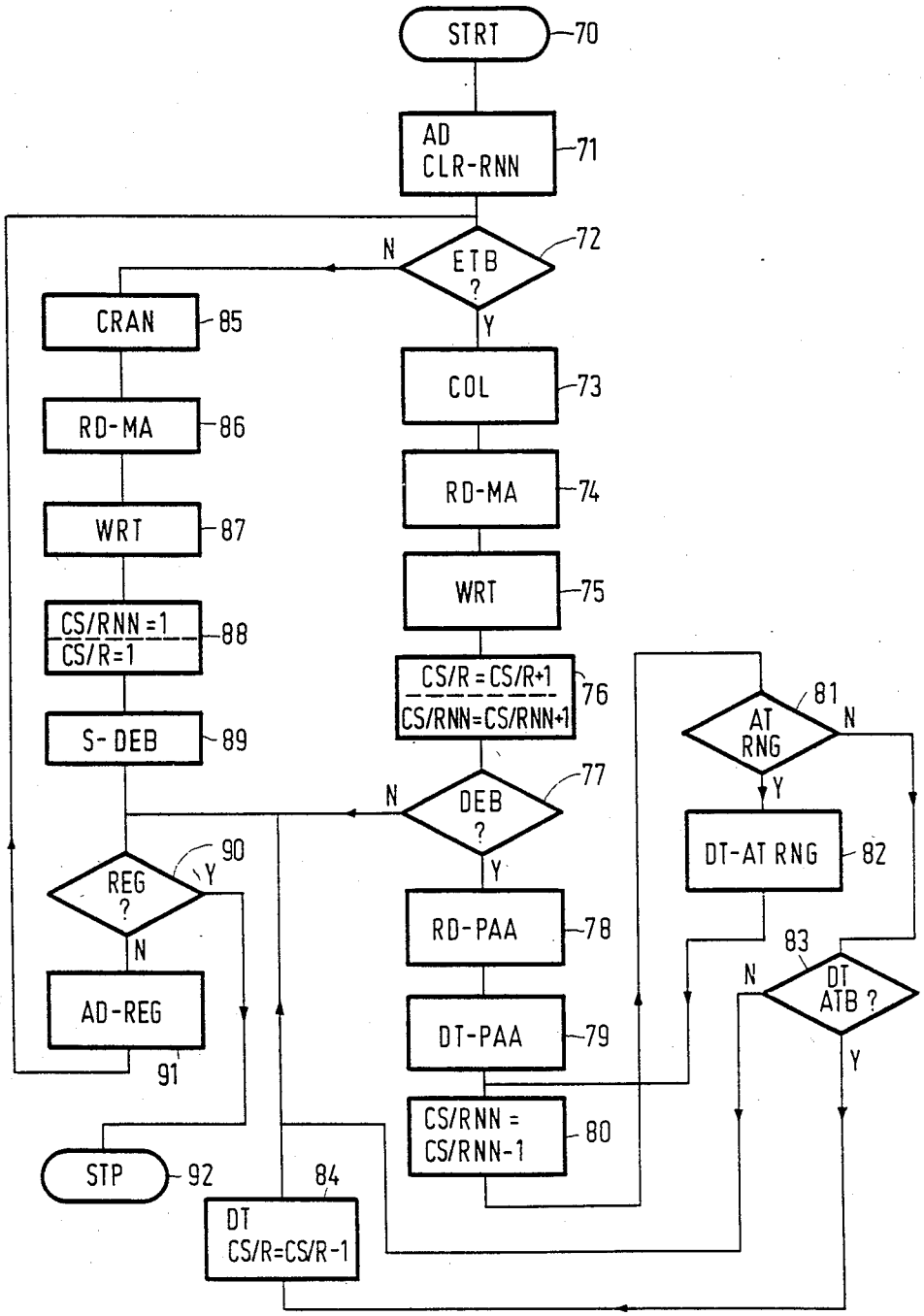
FIG. 9 illustrates the analysis of the content of the received messages by means of a flowchart.

This description will now return to the analysis of the content of the messages and to the use of the roads and regions tables. FIG. 9 illustrates by means of a flowchart the analysis of the content of the received messages. This analysis of the content is carried out each time that a new message has been stored in the reception memory, i.e. after completing the process described in FIG. 5. The data processing unit, in its analysis unit function, then starts (70) the analysis of the content in order to execute the steps mentioned below.

71AD CLR-RNN: The sections CLR-RNN (FIG. 3*c*) of the message are read in order to identify the road concerned.

72 E TB?: This is a test to check if the messages concerning the road, to which the new received message refers, are already contained in the roads table (FIG. 7*b*). For this purpose the data processing unit scans the column CLR-RNN of the roads table.

73 CCOL: in the case in which there are already other messages present for the road in question, the data processing unit has marked the row (R) at which these other messages are stored during step 72, and it will now search for the first free column (C) in the row in question.

74,86RD-MA: the address at which the received message is stored in the reception message is referenced.

75,87 WRT: this address is now written in the roads table at the location (R-C) determined during step 73.

76CS/R=CS/R+1; CS/RNN=CS/RNN+1: the counter CS/RNN of the row (R) in question is incremented by one unit, thus indicating that an additional message has been stored. (The counter CS/R will be incremented in its turn when stage 76 will be executed for a second time on the occasion of the classification of messages according to regions, as described later.)

77 DEB?: this is a test to check if the counting indicated by the counter CS/RNN (or CS/R during the second execution) has not reached the level indicated by the overflow index (DEB-RNN) of the road (or of the region DEB-REG).

78 RD-PAA: in the case in which the number indicated in the column CS/RNN (or CS/R) is equal to the number indicated by the overflow index (DEB-REG or DEB-RNN), the address (PAA) of the oldest message, i.e. in the present case that indicated in the first column of section ADD-MES, is read.

79 DT-PAA: the message stored at the address PAA is eleminiated, as well as the address PAA mentioned in the first column (section ADD-MES). The addresses mentioned in the other columns of the row in question are advanced by one column to the left.

80 CS/RNN=CS/RNN−1: since a message has been destroyed, the counter CS/RNN of the row in question is decremented by one unit.

81AT RNG?: this is a test to check if the message which has been eliminated is also mentioned at other places in the roads table. This is for example the case when a message refers to two different roads, for example when there is an accident on a cross-roads or ice in a region. This test is executed by scanning the roads table looking for the address PAA.

82DT-AT RNG: In the case in which the address PAA has been founded at other locations in the roads table, this reference will be destroyed at those locations and the addresses mentioned in the other columns of the row in question are advanced by one column to the left.

83 DT ATB?: This is a test to check if the message which has been destroyed is also mentioned in the regions table. For this purpose the data processing unit will, with the help of, the roads-regions correspondence table determine the region to which the destroyed message belongs. When the data processing unit will again execute the steps 73 to 84 in order to place the received message in the regions table, it will also carry out, if necessary, a message destruction operation. During this new step 83 the data processing unit will also use the regions correspondence table in order to determine to which road the message, which has been destroyed and which is part of the regions table, refers.

84 DT: CS/R=CS/R−1: if the message which has been destroyed is also found in the regions table, its reference or references there is (are) cancelled, the other messages are advanced by one column and the counter CS/R is decremented by one unit. All traces of the messages which has been destroyed are thus erased.

85 CRAN: in the case in which a received message relates to a road for which there are not yet any other messages (a negative response in step 72), the data processing unit chooses a new row in order to enter there the address of the received message, which will then be written into the first column.

88 CS/R=1: CN/RNN=1: in the case in which a new row has been reserved, the counters (CS/R or CS/RNN) are set to the value "1".

89 S-DEB: The overflow index for the road (region) in question is sampled and stored in the column DEB-RNN (DEB-REG) of the new chosen row.

90 REG?: this is a test to check if the message has already been analyzed on the basis of the region to which it refers.

91 AD REG: in the case of a negative response in test 90, a flag is set in order to indicate that the analysis on the basis of the region is taking place. The data processing unit will then, with the help of the section CLR-RNN and with the help of the roads-regions correspondence table determine, according to the method described above, the region to which the message refers. The program will then be restarted from step 72 this time taking into consideration the regions table.

92 STP: if during test 77, it is established that the analysis on the basis of the region has taken place, the flag is rest to zero and the analysis program is completed.

The destruction of the presence of a message as a result of a number of messages greater than that indicated by the overflow index is an integral part of the analysis program such as described above. It will however be clear that this is only one example and that other embodiments are possible. Thus the test on the basis of the overflow index and the destruction which possibly follows can form an independent program which will be carried out for example during a dead time of the data processing unit.

Figure 10:
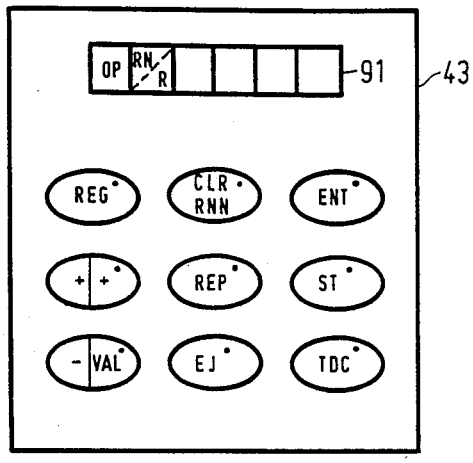
FIG. 10 shows an example of a control keyboard.

The selection of messages will now be described. FIG. 10 shows an example of a control keyboard which is part of the device according of a control keyboard which is part of the device according to the invention. The control keyboard includes a display unit, for example an LCD unit 91 which enables the display of Figures as well as of letters enabling the indication of road categories (motorway, first class road, second class road) or region categories (area, department) of one or more countries. The key CLR/RNN is used to indicate the choice of a road and the key REG is used to indicate the choice of a region. The key +/+ is used in selection mode on the one hand to increment the number displayed on the display unit 91 and on the other hand to indicate a union operation, i.e. that the user desires information on one or more roads and regions. In presentation mode, i.e. during the presentation of messages, this key +/+ is used for a positive displacement of a pointer in a selection table. The key −/VAL is used, in selection mode, on the one hand to indicate an intersection between a road and a region and, on the other hand, to validate the number displayed on the display unit. In presentation mode, this key −/VAL is used to negatively displace the pointer in the selection table. The key ENT enables the entry of the choice that has been made. The key REP enables the repetition of the last message presented. The key ST stops the presentation. The key EJ cancels a message. The key TDC is used for transparency. Each key is provided with an LED diode (indicated by a point) which temporarily lights up when the key in question is pressed. It will be clear that the control keyboard shown in FIG. 10 is only one example and that other embodiments are possible.

The control keyboard also includes an encoder (not shown in FIG. 10) which encodes among other things, the signal produced when a key ENT is pressed in order to form a digital word which is transmitted via the bus 32 to the data processing unit.

When a driver or other user desires road information on a road of his choice he will press the key CLR/RNN, which will then cause the display of a first class of roads, for example the letter A indicating a motorway, on the display unit. If the class of road required is displayed, the user will press the key ENT in order to indicate his choice to the data processing unit. If another class of road than that required is displayed, the user will press the key +/+ in order to display other road classes.

After having entered the class of road required, the user will again press the key CLR/RNN which will cause the display of Figures on the display unit. By means of the key +/+ the user will increment the displayed number until the required road number appears, and he will then enter this number by means of the key ENT. In the case in which the user desires road information on a region he will proceed in a similar way to that of the choice of a road by pressing however the key REG. The indication of a determined region can be made for example by means of a number, for example 75 for the Paris region.

The choice of a number can be made decimal by decimal by using the key −/VAL each time to validate the displayed decimal.

In the case in which the user desires an intersection between a road and a region he will first enter the desired road and after having pressed the key ENT he will press the key −/VAL in order to indicate the intersection operation, before entering the desired region. A union operation is introduced by pressing the key +/+ between the entry of the choice of the road and of the region.

Figure 11:
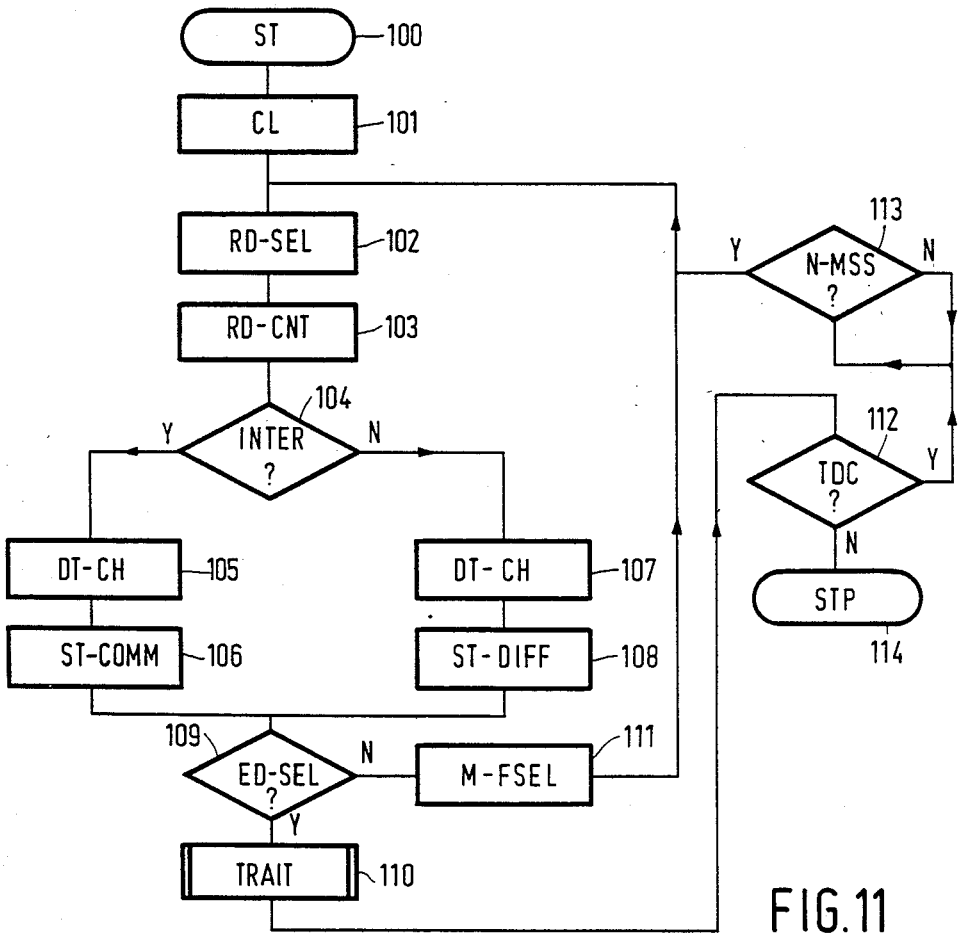
FIG. 11 illustrates an example of a message selection program by means of a flowchart.

When the data processing unit receives commands from a keyboard it will start (100) the selection program illustrated in FIG. 11 by means of a flowchart. The data processing unit will then execute the selection program steps mentioned below.

101 CL: the content of a selection table is deleted. This selection table is for example constituted by part of the working memory, and is used to temporarily store the selected messages, for example by means of the addresses at which they are stored in the reception memory.

102 RD-SEL: the reading of the binary word identifying the user's choice. In the case in which this choice includes a union or intersection operation only, the section referring to the choice of a road or of a region will be taken into consideration during this step.

103 RD-CNT: the content of the selection table is read.

104 INTER?: this is a test to check if an intersection operation is required.

105, 107 DT-CH: the data processing unit will scan the first column of the regions and/or roads table, according to the user's choice, in order to check if there are messages for the region or for the road which the user has chosen. For this purpose the data processing unit compares for example each word of this first column with the binary word received and when there is a positive result of this comparison, the addresses stored in the row in which the required region or road is located are read.

106 ST-COMM: the content of the selection table is compared with the addresses read from the road refenced in stage 105 and, when an intersection operation is required, only those of these addresses which are in both the selection table and in the reference row are maintained in the selection table, the others are erased.

108 ST-DIFF: the content of the selection table is compared with the addresses read in the row referenced in step 107 and, when a union operation is required, the addresses present in the referenced road and which are not yet included in the selection table are entered into it.

109 ED-SEL?: this is a test to check if the operator's entire choice has been taken into consideration.

110 TRAIT: this is a processing subroutine, which will be described in detail below (FIG. 13), and which will enable, during its execution, the presentation of the messages required by the user.

111 M-FSEL: in the case in which the user's choice has not yet been taken into consideration, the operation to be carried out (union or intersection) is referenced. This referencing will then be taken into consideration during the next step 104.

112 TDC?: this is a test to check if the key TDC (transparency) has been used during the selection.

113 N-MSS?: in the case in which the key TDC has been used, the data processing unit will check regularly if new messages have arrived, and if this is the case, the program will be restarted from step 102.

114 STP: this is the end of the selection program.

Let it now be assumed, by way of example, that the driver requires road information on motorway A8 where it traverses the region B2 and that the roads table and the regions table are loaded as shown in FIGS. *7a* and *7b*. On the keyboard 43 he will therefore press the key CLR and then the key ENT when the letter A appears on the display unit. Using the keyt +/+ he will advance the count shown until the FIG. 8 appears. He will then successively press the keys −/VAL, ENT, −/VAL, where the last pressing of the key −/VAL indicates the intersection. Similarly, he will then enter the region B2.

The keyboard will encode the signal from these keys and form them into one or more binary words which it sends to the data processing unit which will therefore start the execution of the selections program by erasing the content of the selection table (step 101). The data processing unit will then read section A8 of the choice and the content of the selection table. Since the first part of the driver's choice is still a union operation, the data processing unit will, after executing step 104, progress to step 107 where it will check if there are messages for motorway A8 stored in the roads table and where it will find these messages in the first row. The data processing unit will read these addresses 12, 13, 28, 34, 38, 52, 71 and store them in the selection table (108). During step 109, the data processing unit establishes that all of the choice has not yet been taken into consideration and it will progress to step 111 where it will detect the intersection operation. It then goes again to step 102 in order to read the choice B2 and to step 103 in order to read the content of the selection table. In step 104, the unit establishes that an intersection operation is required and goes to step 105 where it establishes that there are messages for the region B2 and reads the addresses 12, 21, 34, 38. In step 106 the intersection operation is carried out and the addresses 12, 34, 38, which form the intersection between A8 and B2, are maintained in the selection table, while the other addresses are erased. Since all of the choice has now been taken into consideration (step 109) the data processing unit goes to subroutine 110 in order to present to the driver the messages stored at addresses 12, 34 and 38 in the reception memory. Since the key TDC has not been used, the selection program is completed.

It will be clear that a union or intersection operation is not limited to one region and one road but that it can be extended to several choices, such as for example (B2 U B5) ∩ (A8 U RN64) where the symbol U indicates a union operation and the symbol ∩ indicates an intersection operation. Such a choice will then necessitate several runs of the selection program.

The user's choice can again be formulated as follows. In fact it can be imagined that when a driver is to use a motorway which extends over several hundres of kilometers, for example like the motorway A5 in the Federal Republic of Germany, which goes from Darmstadt to Basle, and that when the driver will only use part of this motorway, for example the part between Heidelber and Karlsruhe, he will only be interested in road messages relating to the section that he will use. The driver will then request, using his keyboard, the intersection between A5 and the Heidelberg-Karlsruhe region. In such case the intersection can be selected via the keyboard. It will suffice to key in the exit numbers concerned on the keyboard.

Road information can also play a role in the programming of a route such as performed by a road navigation system for vehicles. Such road navigation systems are for example described in the article "Elektronische Lotsen" which appeared in Funkschau No. 22, 1986, pages 99–102. A road navigation system for vehicles is equipped with means of determining a route between a start point and a destination. The device according to the invention can be connected to a road navigation system and thus the means of determining the route can take into account the road information relating to the roads which compose the path to be travelled.

Let it now be assumed that the navigation system must determine a route between a starting point and a destination entered by the driver and that the route as initially determined includes among other things a motorway whose exit to be used is blocked by roadworks. When the navigation system has determined its route it will then, for each road or only for the main roads of its route, ask the device according to the invention for the road messages. This can be performed for example by transmitting to the data processing unit a call indicating that road information is requested, and the binary code of the road or roads in question. The data processing unit will then process these requests in a way similar to that used for controls coming from the keyboard, and will transmit the required information to the navigation system. In this road information the navigation system will now detect that the exit of the motorway to be used according to the initially provided route is blocked, and will request the means of determining a route to determine a new route wherein the exit in question is avoided. The navigation system in cooperation with the device according to the invention thus enables the driver to avoid obstacles or traffic jams.

Since each message includes a section ST indicating a probable duration of the problem, this section ST can also be taken into consideration in the determination of the route. Returning to the example of the blocked motorway exit, let it be assumed that the section ST indicates "up to 16 hours" and that the driver starts at 15.30 and that the exit in question is located 150 km from the start point. The navigation system will then be provided with means for taking this information into consideration. Thus it will be equipped with a computer which will indicate to it that at an average speed of 100 km/h on the motorway he will need one and a half hours to reach this exit. This value of one and a half hours will then be added to the present time (15.30) indicated by the clock in the car (15.30+1.30=17.00). The navigation system will be equipped for comparing this computed time (17.00) with the time indicated in ST (16.00) and it will not that for the time at which the driver will have reached the exit in question, this exit will be open gain. The means of determining a route will not, in this case, receive instructions to determine a new route. Similarly, the navigation system working in conjunction with the device according to the invention can also take the section STT into consideration when determining a route.

Before explaining how a selected message is presented to the user, it is necessary to give a more detailed description of two tables which will be used for performing this presentation.

The device according to the invention uses, to enable the presentation of a message, an extension table (36, FIG. 4) and a places table (37, FIG. 4), which are illustrated in FIGS. 12*a* and *b* respectively. This extension table and this places table also can be entered in the read only memory 35 and the ETTD. In the case where they are formed from independent memories connected to the bus 32, they can, if necessary, even be in the form of cassettes or memory boards.

The extension table (FIG. 12*a*) is addressable by means of the section CLR-RNN of the message as will as the section PR-LOC. For each road there is a number of reserved rows, and a row includes a section ORD indicating a specific place on the road, for example an exit or a rest area for a motorway, and a cross-roads for a first or section class road. A row also includes a section ADR indicating a place in the places table. Advantageously each row is not necessarily filled with information, which enables in the case where it is possible to write into the table (EEPROM memory, or magnetic tape) to add new information at the required places, for example new motorway exits.

The table of places of addressable by means of the address taken from the extension table (column ADR), and includes a column TXT APP reserved for the name of the indicated place, a column PAR where there is stored the code to be used by the speech generator in order to form a spoken word thereof, and a column REG indicates the region to which the indicated place belongs.

In order to present a received message to the speech generator, the data processing unit will now proceed in the way described below. Let it be assumed that the message relates to the motorway A7 (=CLR-RNN) in the Federal Republic of Germany and that the section Pr-LOC indicates the value 2 of the received message, it then reads the section CLR-RNN and the section PR- LOC. The sections CLR-RNN and PR-LOC now form an address A7,2 for addressing a location in the extension table. The data processing unit will address this location A7,2 and read the data 1024 which it will use for addressing the places table. At the location bearing the address 1024 in the places table it will find the code 022*c* which it presents to the speech generator which will form "HAMBURG" in the form of speech. Then the data processing unit will read the section DIR-OFFS of the message. Let it now be assumed that this section DIR-OFFS indicates the binary value 01010 indicating a positive shift of 10 to be added to PR-LOC. The data processing unit will now add this value 10 to PR-LOC=2 and obtain the value 12, which forms an address for another location in the extension table. At the location A7,12 the value 1247 is stored and at the address 1247 of the places table the code 021*q* is stored. The data processing unit then presents this value 021*q* to the speech generator which forms from it the word "KIEL" in the form of speech.

The advantage of using the OFFS section of the message, of the extension table and the places table can thus be seen. The use of the section DIR-OFFS enables the indication of a second place in the message while limiting the number of bits necessary for this operation since the section DIR-OFFS always indicates a relative value with respect to the value PR-LOC. Thus it is not necessary to mention a second value for CLR-RNN (16 bits) nor to mention a second value for PR-LO (16 bits). The section OFFS thus compresses the information of this second place into five bits. The extension table and the places table thus enable the second place to be found in the way described above. The section DIR-OFFS, the extension table and the places table offer the same advantage when presenting messages as will be described later in the description.

Figure 13:
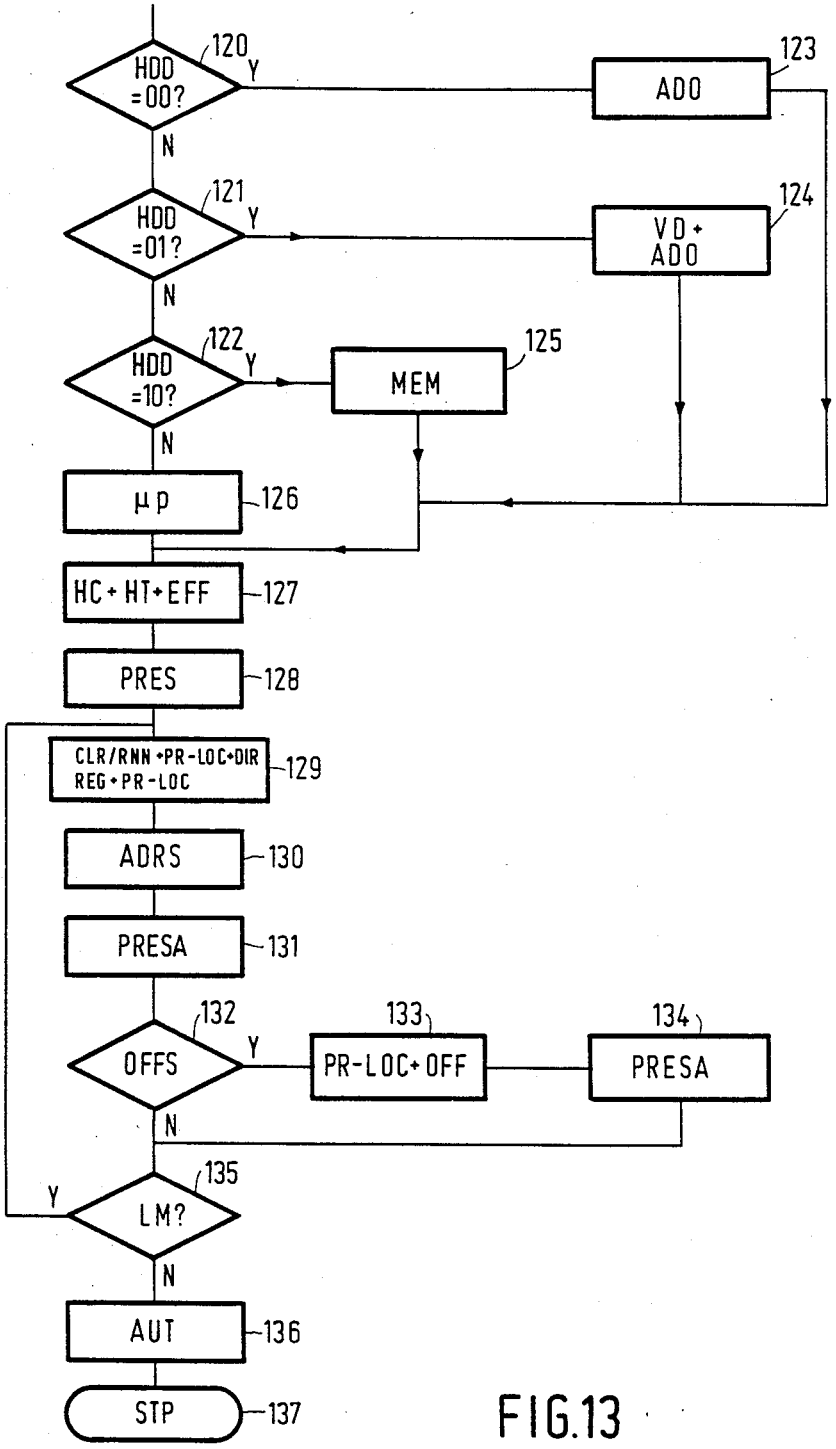
FIG. 13 illustrates an example of a message presentation subroutine by means of a flowchart.

The presentation of the message (step 110, FIG. 11) will now be described in more detail with the help of the flowchart shown in FIG. 13. In the first three steps:

| | |
|---|---|
| 120 HDD = 00? | |
| 121 HDD = 01? | the data processing unit checks HDD on the |
| 122 HDD = 10? | indicated value. |

123 ADO: the starting of the speech generator (39, FIG. 4)

125 MEM: the generation of a write signal for the memory where geographic data are stored

126 μp: reservation of a first buffer register in the data processing unit. Since HDD has the value 11 it is therefore intended for the data processing unit.

127 HC+HT+EFF: the combination of the values HC+HT+EFF forms one or more addresses for addressing one or more locations in a local memory of the speech and/or picture generator, depending on which has been actuated. At the indicated addresses are located the binary words by means of which the audio or visual representation of the information coded in HC+HT+EFF will be produced

128 PRES: This is the presentation to the user of the information coded in HC+HT+EFF

129 CLR/RNN+PR−LOC+DIR REG+PR−LOC: The extension table is addressed by means of the address formed by CLR/RNN+PR+LOC and the word ADR which is stored at this location is read

130 ADRS: The word ADR is used for addressing the places table and the code which is stored at this location is transmitted to the speech and/or picture generator.

131, 134 PRESA: With the help of the code which it has received, the generator in question will perform the presentation of the information coded in CLR/RNN+PR−LOC+DIR

132 OFFS?: This is a test to check if there is an OFFS value other than 00000 or 10000, indicating a second location in the message.

133 PR−LOC+OFF: In the case where there is a second location in the message, the value OFF is added to the value PR−LOC and will thus form an address for a second location in the extension table and in the places table.

135 LM?: This is a test to check if it is a long message.

136 AUT: The other sections (SAV, DAV) of the group, if present, are transmitted to the generator in question and presented to the user.

137 STP: End of the program.

Figure 14A:
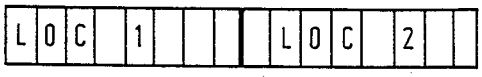
FIGS. 14*a* and 14*b* show an alternative form of the subsequences SMR2 of two successive groups.
Figure 14B:
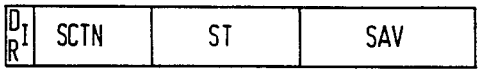

FIGS. 14*a* and *b* illustrate an alternative form of the subsequences SMR2 of two successive groups. The subsequence shown in FIG. 14*a* includes a section LOC1 (8 bits) and a section LOC2 (8 bits), each of which indicate a respective location to which the message refers. In the subsequence illustrated in FIG. 14*b*, the section DIR, ST and SAV are similar to those of the groups shown in FIG. 3*d*, and the section SCTN represents a section of the road, mentioned in the section CLR-RNN of the message, for example the section between the Karlsruhe and Strasbourg exits on the motorway A8 in, the Federal Republic of Germany. In fact, when the format shown in FIGS. 14*a* and *b* is used, each road of the road system has been divided into different sections (32 sections maximum if the section SCTN includes 5 bits) and the locations LOC1 and LOC2 then refer to the section mentioned in SCTN.

Figure 15:
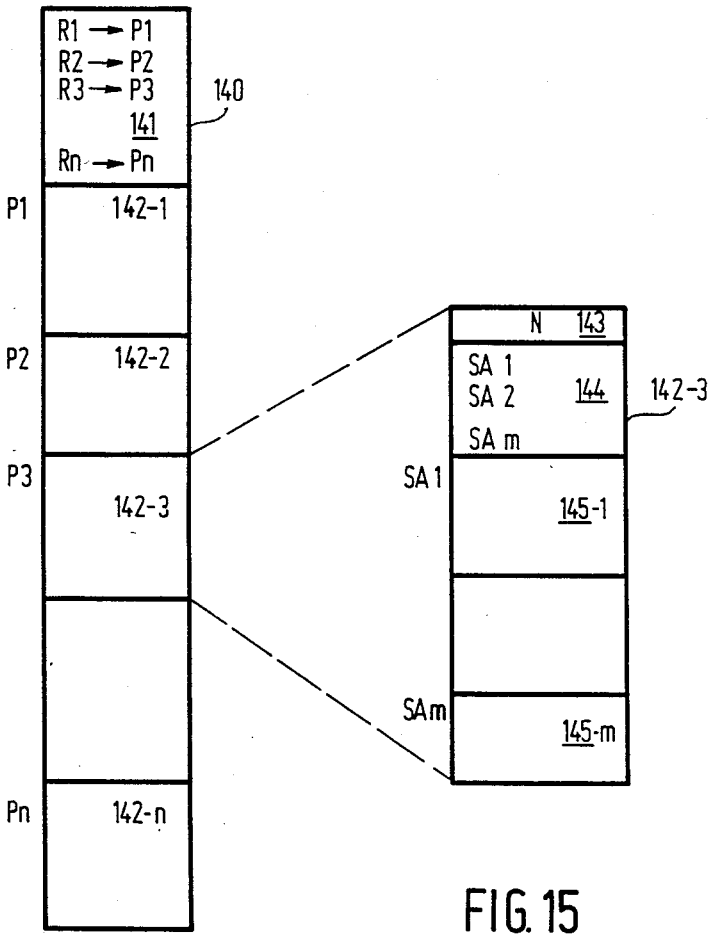
FIG. 15 shows a different configuration of the extension table.

The choise of the format shown in FIGS. 14*a* and *b* naturally implies a different configuration of the extension table, which is illustrated in FIG. 15. This different configuration is situated in the addressing level of this table, the content of the section ADR being equal to that in FIG. 12*a* but organized in a different way. For reasons of clarity, the section ADR has not been shown in FIG. 15 includes a first list of addresses 141 and n sections 142-*i* ($1 \leqq i \leqq n$). The first address of each section 142-*i* is indicated by a letter Pi. The first list of addresses 141 includes these n addresses Pi and address Pi is assigned to each road Ri of the road network. The first list of addresses is addressed by means of the section CLR-RNN of the message and indicates for the road CLR−RNN=Ri an address Pi which is the first address in section 142-*i* of the extension table. This section 142-*i* includes:

- a first subsection 143 which contains a number N indicating how many sections the road in question Ri is divided into;
- a second subsection 144 includes a second list of addresses which is addressable by means of the section SCTN of the message (FIG. 14*b*) and indicates for each section SCTN(i) an address SA(i) which is the first address of a third subsection 145-*i*.
- m third subsection 145-*i* ($1 \leqq j \leqq m$). The different locations of each third subsection being addressable by means of the section LOC1 or LOC2 of the message and at each location thus addressed there is stored an address ADR (see FIG. 12*a*) indicating a location in the places table.

The addressing of this extension table illustrated in FIG. 15 will now be described by means of an example. Assume that the message is as follows (FIG. 14 format):

| | |
|---|---|
| CLR-RNN = | R8 (=A8) |
| SCTN = | 2 |
| LOC1 = | XX |
| LOC2 = | YY |

When such a message must be presented to the driver, the data processing unit will address in the first list of addresses 141 the location R8 and there read the address P8, indicating the first address of the section 142–8. At this address P8 there is stored the number N, for example N=11 indicating that the road R8 contains 11 sections. The data processing unit will then form the address P8+SCTN=P8+2 in order to address the location P8+2 in the second list where the place P8+2 is stored, the address SA2 indicating the first address of the subsection 145–2. The data processing unit will then form the address SA2+LOC1=SA2+XX in order to read at the address SA2+XX the address ADR1 which is stored. This address ADR1 then indicates the location in the places table where the name of the place to which the section LOC1 of the message is stored. The presentation of this section will then be carried out in the way described above. The data processing unit will also form the address SA2+LOC2=SA2+YY and will read the address ADR2 stored at this location SA2+YY in order to form a second place to which the message refers. Thus it is possible to indicate two locations in a same section of a same road by means of a same message.

What is claimed is:

1. Device for receiving and processing road information messages transmitted in digital form, each message including at least a first section for indicating a respective zone, of a road network, to which respective zone the message refers, which device comprises:

(a) a data processing unit for data processing control;

(b) a bus, connected to the data processing unit, for transferring data;

(c) a reception memory, connected to the bus, for storing received messages;

(d) a selection unit, connected to the bus, for enabling selection from among the received messages stored in the reception memory of those received messages concerning a zone to be designated; and (e) a presentation unit, connected to the bus, for presenting selected messages, selected by the selection unit;

wherein the improvement comprises:

(f) a message analysis unit, which includes a zones table memory, which message analysis unit is for:

(i) recognizing each respective zone referred to by the received messages, on the basis of the first section of each received message; and (ii) storing in the zones table, by means of at least one indicator for each received message, the received messages according to the zones to which they refer, and that (g) the selection unit accesses the zones table and carries out the selection by fetching messages for the designated zone from the zones table.

2. Device according to the first claim wherein:

(a) different zones of the road network correspond to roads and are indicated by a category and a road number, (b) the zones table memory includes a table of roads where the received messages are placed according to the roads to which they refer, and (c) the at least one indicator is at least one respective address at which the received messages are stored in the reception memory.

3. Device according to claim 2, wherein:

(a) the device includes (i) a roads-regions correspondence table for storing, for a predetermined number of roads of the road network, to which the roads-region correspondence table refers, a respective overflow index indicating a respective maximum number of road messages for each respective one of the roads of the predetermined number of roads, (ii) a verification unit connected to the roads-regions correspondence table and to the roads table in order to verify if the number of messages stored for each road has not reached the respective maximum number indicated by the respective overflow index for the respective road, and in order to eliminate a message for a road for which the number of messages stored in the roads table has reached the respective maximum number indicated by the respective overflow index.

4. Device according to claim 3, further comprising a referencing unit which includes a roads-regions correspondence table for storing at least one respective second index for each respective road of a predetermined number of roads of the road network, the respective second index indicating at least one region traversed by the respective road.

5. Device according to claim 4, further comprising:

(a) a regions-roads correspondence table for storing for each respective region of a predetermined number of regions a respective overflow index indicating a respective maximum number of road messages for each of the respective regions of the predetermined number of regions, (b) a verification unit, connected to the regions-roads correspondence table and to the regions table, for (i) checking if a number of messages stored for each respective region has not reached the respective maximum number indicated by the respective overflow index for the respective region, and (ii) eliminating a message for a region whose number of messages stored in the regions table has reached the respective maximum number indicated by the respective overflow index.

6. Device according to claim 5, wherein the regions-roads correspondence table includes, for each respective region, an indication of at least one road traversing the respective region.

7. Device according to claim 6, wherein the verification unit references, with the help of the roads-regions correspondence table and the regions-roads correspondence table, respectively, to which region and to which road, respectively, a message eliminated by the verification unit refers and also for eliminating from a first one of the regions table and the roads table a message which has been eliminated from the second one of the roads table and the regions table.

8. Device according to claim 2, wherein:

(a) the zones of the road network correspond to regions of at least one state,
(b) the device further comprises a detecting unit for detecting respective regions referred to by the received messages,
(c) the message analysis unit is connected to the detecting unit,
(d) the zones table memory includes a regions table where the received messages are placed according the regions to which they refer, and
(e) the at least one indicator is at least one respective address at which the received messages are stored in the reception memory.

9. Device according to claim 3, wherein the verification unit eliminates an old message from among the number of messages which has reached the respective maximum number indicated by the overflow index.

10. The device of claim 3 wherein the roads-regions correspondence table stores the respective overflow index for all of the roads of the road network.

11. Device according to claim 1, wherein:
(a) the zones of the road network correspond to regions of at least one state,
(b) the device further comprises a detecting unit for detecting respective regions referred to by the received messages,
(c) the message analysis unit is connected to the detecting unit,
(d) the zones table memory includes a regions table where the received messages are placed according the regions to which they refer, and
(e) the at least one indicator is at least one respective address at which the received messages are stored in the reception memory.

12. Device according to claim 11, further comprising:
(a) a regions-roads correspondence table for storing for each respective region of a predetermined number of regions a respective overflow index indicating a respective maximum number of road messages for each of the respective regions of the predetermined number of regions,
(b) a verification unit, connected to the regions-roads correspondence table and to the regions table, for
(i) checking if a number of messages stored for each respective region has not reached the respective maximum number indicated by the respective overflow index for the respective region, and
(ii) eliminating a message for a region whose number of messages stored in the regions table has reached the respective maximum number indicated by the respective overflow index.

13. Device according to claim 12, wherein the regions-roads correspondence table includes, for each respective region, an indication for at least one road traversing the respective region.

14. The device of claim 12 wherein the regions-roads correspondence table stores the respective overflow index for all of the roads of the road network.

15. Device according to claim 12, wherein the verification unit eliminates an old message from among the number of messages which has reached the respective maximum number indicated by the overflow index.

16. Device according to claim 1, wherein:
(a) each respective received message includes at least one respective sequence composed of two blocks, and wherein each respective block includes a respective information section and a respective control section, the respective control section also including a respective shift word for synchronizing the respective block, and wherein for a predetermined block a first and a second shift word are used, the first shift word being used for a first sequence of the respective received message and the second shift word being used for another sequence of this same respective received message, and
(b) the device further comprises:
(i) a decoder for decoding the respective shift words of the received messages and generating a setting signal when decoding the first shift word, and
(ii) a sequence counter connected to the decoder, which sequence counter is set under control of the setting signal.

17. Device according to claim 1, wherein the selection unit enables the selection from an intersection and/or a union of at least two zones.

18. Device according to claim 1, wherein the selection unit comprises a key for actuating immediate presentation, after reception, of a message for a selected zone.

19. Device according to claim 1, further comprising a road navigation system for vehicles comprising:
(a) means for determining a route between a start point and a destination, said determining means comprising means for:
(i) analyzing the received messages and recognizing in the received messages if there is a traffic problem in the designated zone; and
(ii) determining, in the case of the traffic problem, a new route, and
(b) means for transmitting to the selection unit an indication of at least one zone traversed by the route and for receiving the messages relating to the designated zone.

20. Device according to claim 1, wherein
(a) the message includes several sections for entering coded words representing various sections of information of the messages, and
(b) the device further comprises a conversion memory connected to the presentation unit and which is addressable by coded words and wherein are stored other coded words for presentation of the message.

21. Device according to claim 20, wherein
(a) each message includes a second section containing a location indication relating to a location situated in the zone to which the message refers, and
(b) the conversion memory contains a conversion table which stores, in the form of the other coded words, different location indications of at least one state to which the road information refers.

22. Device according to claim 21, wherein
(a) each message includes a third section containing a shift value enabling indication of another location relative with respect to the location indicated in the second section, and
(b) the device further comprises an address generator for forming an address for the conversion memory on the basis of the second and third sections of the message.

23. Device according to claim 22 or 24, wherein the conversion memory includes an extension table and a places table, the extension table including for each address formed by the first and second and/or on the basis of the first, second and third sections, an address indicating a location in the places table.

24. Device according to claim 21, wherein the second section is divided into a first subsection indicating a section in the zone entered in the first section, a second and third subsection respectively indicating a first and second location respectively in the section indicated in the first subsection, and the conversion memory is divided into n sections and includes a first list of addresses indicating the first address of each of the n sections, a location in the first list of addresses being addressable by the first section of the message, each of the n sections being divided into m subsections and including a second list of addresses addressable by the said first subsection of the message and including the first addresses of each of the m subsections, a location in one of the m subsection being addressable by the second or third subsections.

* * * * *